United States Patent [19]

Cotton

[11] 4,091,829

[45] May 30, 1978

[54] VERTICAL LIQUID ELECTRODE EMPLOYED IN ELECTROLYTIC CELLS

[76] Inventor: Donald J. Cotton, 1101 3rd St. SW., Washington, D.C. 20024

[21] Appl. No.: 765,198

[22] Filed: Feb. 3, 1977

Related U.S. Application Data

[63] Continuation-in-part of Ser. No. 626,308, Oct. 28, 1975, Pat. No. 4,040,932.

[51] Int. Cl.[2] ..... C25B 1/36

[52] U.S. Cl. ..... 137/1; 204/99; 204/220

[58] Field of Search ..... 137/2, 1; 204/219, 220, 204/250, 272, 251, 99

[56] References Cited

U.S. PATENT DOCUMENTS

| | | | |
|---|---|---|---|
| 586,729 | 7/1897 | Kellner | 204/99 |
| 679,477 | 7/1907 | Kynaston | 204/219 |
| 2,849,393 | 8/1958 | Deprez | 204/219 |
| 3,065,163 | 11/1962 | Honsberg | 204/220 |
| 3,332,868 | 7/1967 | Friese | 204/219 |
| 3,408,281 | 10/1968 | Barnard | 204/220 |
| 3,481,856 | 12/1969 | Csizi | 204/220 |

*Primary Examiner*—Alan Cohan

[57] ABSTRACT

A vertical liquid electrode is employed in an electrolytic cell used to manufacture chemical products by the electrolytic decomposition of an electrolyte. The cell incorporates the advantages of high current density, high current efficiency, low space requirement, low liquid electrode requirement, and convenience of optional diaphragm employment.

2 Claims, 4 Drawing Figures

VERTICAL LIQUID ELECTRODE EMPLOYED IN ELECTROLYTIC CELLS

This is a continuation-in-part (as to all common matter) of application Ser. No. 626,308 filed 28 Oct. 1975 now Pat. No. 4,040,932 .

This invention relates to a method of creating, maintaining, and controlling a vertical component of liquid surface by the novel employment of capillary troughs. By way of example, the method is demonstrated through its use to create a liquid electrode with an active vertical surface suitable for use in electrolytic cells, particularly in cells of the liquid metal electrode type and, more particularly in cells that utilize a mercury cathode in the electrolysis of molten metal halides, or their solutions, to produce halogen gas and a metal, its amalgam, its hydroxide, or its oxide. The use of the method of the present invention to create other embodiments of the electrode for other applications, both electrical and nonelectrical, e.g., to create a liquid-liquid or liquid-vapor heat exchanger element, or to create a solvent extractor, is also contemplated.

A typical example of an electrolytic cell containing a horizontal liquid electrode is the mercury cell used to produce chlorine gas and alkali amalgam from aqueous alkali chloride. The cell consists of an enclosed structure having a flat retangular, sloping bottom along which mercury flows under gravity to form the cathode surface. The underside of graphite blocks suspended above the mercury form the anode surface. The electrolyte is forced to flow in the small space between the mercury and the graphite surfaces. During operation, chloring evolves on the underside of the graphite anode, and dissolved alkali metal as amalgam, along with a proportionally small quantity of evolved hydrogen gas, forms at the mercury cathode.

Horizontal cells have inherent disadvantages. It is difficult to install and to maintain the invariably heavy cell in positin and tedious to control the flow of mercury so that the cell bottom surface is always completely covered by a uniform layer having minimum thickness. Moreover, mercury is expensive, and the volume required to operate a practical cell is considerable. At high current density, a high overvoltage on the graphite anode and high ohmic resistance in the electrolyte occur because the chlorine gas evolved on the anode underside is difficult to remove. At high alakli metal concentration in the mercury cathode, the hydrogen evolution rate increases, and above certain proportional limits, hydrogenchlorine mixtures are explosive. Furthermore, employment of a suitable diaphragm, ususally a flexible material, to prevent hydrogen and chlorine mixing is impractical because of the horizontal position in which it must be maintained.

The main obstacle to constructing cells with an obviously preferred vertical electrode orientation is that of maintaining and controlling a liquid electrode in vertical position. U.S. Pat. Nos. 586,729 and 784,592 disclose cells which utilize a liquid cathode that has a component of vertical flow. Although the cells have vertical anodes, the liquid cathode surfaces are horizontal which actually result in configurations that are more disadvantageous than conventional horizontal cells, despite the vertical motion of the cathode liquid. Attempts to create a practical active vertical liquid surface almost all utilize a suitable vertical solid surface wetted with the cathode liquid. The cathode liquid either flows under gravity as a film down the stationary vertical solid surface, or a film is formed on the vertical solid surface by mechanically dipping it into the cathode liquid. The main disadvantages of these vertical cells are that of maintaining the solid surface completely covered with cathode liquid, that of controlling the surface flow rate of the cathode liquid, and that of maintaining uniform thickness of the cathode liquid layer.

In the present invention, none of the previously discussed means is used to create cells having a liquid electrode with an active independent vertical surface. In this invention, a capillary trough is defined as a section of a hollow capillary tube bisected parallel to its longitudinal (long) axis by a plane that forms the longitudinal plane surface of and bounds the longitudinal opening of the section. A horizontal capillary trough is so orientated that its longitudinal plane surface is approximately horizontal and its longitudinal opening is located at its top. This invention makes the unobvious utilization of small (1.0–5.0 millimeter cross section) capillary troughs constructed of material to which the electrode liquid is nonadhesive, that is material which is not wetted by the electrode liquid. The distance across the capillary trough approximately equals twice (2) the electrode liquid capillary constant which is defined as the square root of twice (2) the interfacial tension of the electrode liquid divided by the product of the earth's gravitational constant (980.1 centimeters per second per second) and the difference in the densities of the electrode liquid and its surrounding medium. When a capillary trough of this size is sufficiently filled with liquid, a stable meniscus projects above the trough edge and exposes, thereby, a liquid surface with a large vertical component. Because the liquid is nonadhesive to the capillary surface, its interfacial tension attracts its bulk inward and prevents its flowing over the trough edge. Moreover, the capillary trough is of such small cross section that the meniscus volume projecting above the trough edge is greater than, or equal to, the liquid volume below the trough edge. Thus, relative to the total volume, a proportionally large liquid vertical surface component projects above the trough edge as an active vertical electrode surface. The capillary trough is constructed with bot external longitudinal edges flat to simplify its attachment to a supporting structure, to sheld the meniscus from the force of electrolyte flowing through the cell, and to facilitate the optional attachment of a diaphragm.

An advantage of the cathode of this invention is lower power consumption per weight of electrolysis product generated than is possible with conventional horizontal cells. Because the electrodes are vertically orientated, evolved gases readily escape and electrolyte resistance is low. Consequently, the cell can be operated at a higher current density for a particular cell voltage, or at a lower cell voltage for a particular current density, than a horizontal cell with equivalent output capacity. A second advantage is a low cathode material requirement because the ratio of liquid mass to active electrode area is considerably lower for that of cathodes in conventional horizontal or mechanical vertical liquid electrode cells. A third advantage is that it is easier to control the flow of the electrode liquid confined in a capillary trough than to regulate the flow o the liquid films utilized in other vertical liquid electrodes. A fourth advantage is the elimination of problems due to nonuniformity of liquid film thickness and concomitant fluctuations in electrode separation, as well as problems due to incomplete surface coverage which arise in other vertical liquid electrodes; inasmuch as this invention employs neither a liquid film nor a surface requiring coverage by the electrode liquid.

Another advantage of the electrode of this invention is the wider range of readily available materials suitable for its construction than that for other vertical liquid electrodes which require materials that are wetted by the electrode liquid. A suitable electrode liquid in the present invention is any metal, or alloy, that is a low vapor pressure liquid immiscible with, chemically inert to, and having a greater density than the cell electrolyte and that has a low overvoltage for the desired electrode product at the cell operational temperature and pressure.

Examples of suitable electrode liquids in this invention are mercury, gallium, tin, bismuth, cadmium, lead, and their low melting alloys. Suitable material for capillary trough construction is any nonconductive substance which possesses suitable mechanical properties, which is nonadhesive to the electrode liquid, and which can withstand the temperature, pressure, and chemical environment within the cell during its operation. Examples of suitable capillary trough materials, depending upon cell operational conditions, are, at moderate temperatures: polymeric resins and hard rubbers, and, at high temperatures: glasses, ceramics, and refractories.

In accordance with this invention, a flat electrode is constructed by attaching a longitudinal edge of the capillary troughs to a flat, vertical support plate so as to form a covering pattern of slightly inclined, closely spaced, parallel horizontal rows. A cylindrical electrode is constructed by attaching the capillary troughs in parallel helices around a hollow, support cylinder. Alternatively, the support consists of a series of suitable parallel, vertical, rigid rods attached at intervals to the longitudinal sides of the capillary troughs arranged in parallel horizontal rows or helices so as to form a rigid grate-like structure which permits both sides of the meniscus to be utilized as an active electrode surface. An advantage of the electrode according to this invention is an extremely low space requirement; inasmuch as the long dimension of a conventional horizontal cell is effectively either folded into thin, short vertical sections or wrapped around a vertical cylinder of small volume.

Where the support structure is of metal, its surface is covered with a thin layer of nonconductive material. Suitable materials for the construction or for the covering of support structures are the same as those used for the construction of capillary troughs. Suitable means for attaching the troughs to support structures are by fusing, by welding, or by adhesives, such as epoxy resins. Alternatively, the troughs are cast, molded, extruded, or machined into the construction material to form an integral part of the support structure.

By way of example, embodiments of electrode created by the method of this invention for the electrolysis of aqueous alkali chloride using mercury as the cathode liquid are shown diagramically in the accompanying FIGS. 1–4.

Figure 1:
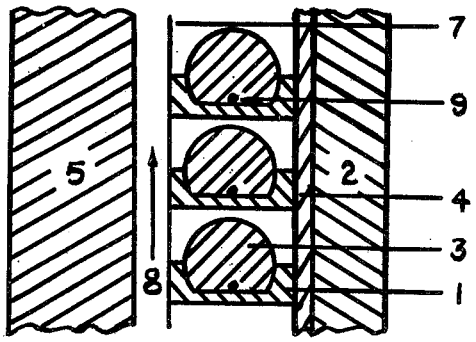
FIG. 1 is a magnified cross section of a typical cathode-anode pair in a cell. An optional diaphragm is also shown.

More particularly, FIG. 1 illustrates a typical cross section normal to the longitudinal axis of a cathode-anode pair in a cell according to this invention. 1 is a capillary trough which is nonadhesive to mercury and which, at its top, has an opening that approximately equals twice the capillary constant of mercury (typically: 5.0±0.5 millimeter) in the cell environment. 3 is mercury which, because of the size of the capillary trough opening, forms a meniscus that has an approximately circular cross section which projects above the trough edge. The vertical component of the projecting surface area of the meniscus acts as a cathode surface in parallel to the surface of 5, the anode. The capillary trough 1 is attached to a metallic support plate 2 covered with a layer of nonconductive material 4. The trough has a flat exterior edge to which an optional diaphragm 7 is attached. The diaphragm 7 effectively divides the space between the cathode and the anode into two separate chambers so as to segregate the cathode and the anode evolved gases. The electrolyte, aqueous alkali chloride, is forced to flow in the space between the cathode and the anode in the direction indicated by arrow 8. A wire metal conductor 9 insures electrical continuity through the mercury.

Figure 2:
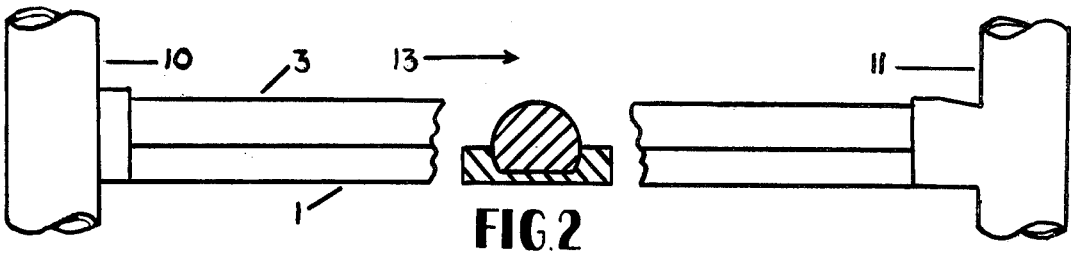
FIG. 2 is a magnified longidinal side view of a capillary trough filled with mercury. The electrode liquid inlet, outlet, and collector are also shown.

FIG. 2 illustrates a capillary trough in a flat electrode configuration. The trough is filled with mercury 3 that flows in the direction indicated by arrow 13. Mercury enters the trough through a T-inlet 10 connected to a feed line which runs from a suitable reservoir-metering arrangement located above the cell. The feed line inner cross section is tapered along its length, from trough to trough, to compensate for increased hydrostatic pressure due to height. The vertical component of the exposed surface of the mercury meniscus is utilized as a vertical liquid cathode, the capillary trough outlet 11 connects into a collector 13 which is common to all the troughs comprising the electrode.

Figure 3:
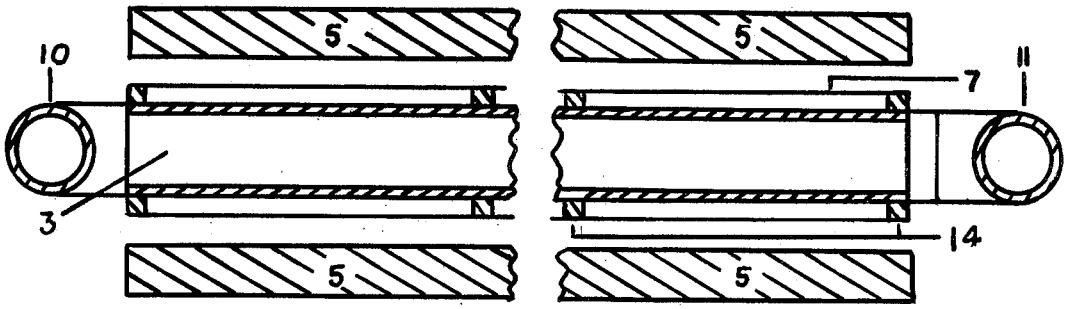
FIG. 3 is a magnified top view of a capillary trough filled with mercury. Support rods, an optional diaphragm, and a portion of the anode are also shown.

FIG. 3 is a top view of a capillary trough in a flat configuration which is supported by suitable vertical, parallel, rigid rods 14 spaced at intervals so that the meniscus surface projecting above the capillary trough edge is utilized as a cathode surface by anodes 5 located parallel to its opposing sides. An optional diaphragm 7 is attached to the support rods.

Figure 4:
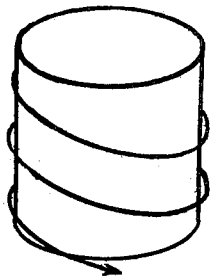
FIG. 4 is a perspective of a cylindrical electrode configuration and shows, in exaggeration, the electrode liquid flow direction.

FIG. 4 shows, in exaggeration, the direction of flow of the mercury through a capillary trough wound in a helix around a supporting cylinder. Mercury is fed to the trough from a suitable reservoir-metering arrangement located above the electrode. Its flow rate is predetermined by the pitch of the capillary trough helix.

Although the invention has been described with a certain degree of particularity, especially in the use of cells for the electrolytic decomposition of aqueous alkali halide using mercury as a cathode liquid, it is to be understood that the present disclosure is made only by way of example and illustration and that numerous changes in application, in construction details, and in the arrangement and combination of parts may be made without departing from the spirit and the scope of the invention hereinafter claimed.

Two nonexclusive examples of other applications are as follows: The method can be used to create a heat exchanger element wherein the electrode liquid exchanges heat energy, through conduction and convection, with an immiscible surrounding medium, or through radiation with a non-interfacial medium. The method can also be used to create a component of a liquid extractor wherein the electrode liquid selectively extracts, through dissolution, emulsification, or adsorption, one or more constituents from a solution of an immiscible (with the electrode liquid) solvent which comprises the surrounding medium, or the electrode liquid can be a solution from which a surrounding immiscible solvent extracts one or more constituents.

I claim as my invention:

1. A method of creating, maintaining, and controlling a vertical component of a liquid surface which consists of confining said liquid in a horizontal capillary trough to which said liquid is non-adhesive, so that a meniscus with a vertical component of surface of said liquid projects above the edge of said capillary trough.

2. The method as claimed in 1, wherein said method further consists of controlling the rate and direction of flow of said meniscus by means of the geometric shape of said capillary trough along its longitudinal axis.

* * * * *